United States Patent [19]

Brumley et al.

[11] 4,000,549

[45] Jan. 4, 1977

[54] STABILIZER

[75] Inventors: Ralph E. Brumley; Mathew B. Riordan; Richard H. Bentley, all of Houston, Tex.

[73] Assignee: Eastman-Whipstock, Inc., Houston, Tex.

[22] Filed: July 14, 1975

[21] Appl. No.: 595,891

[52] U.S. Cl. ..... 24/263 KS; 308/4 A

[51] Int. Cl.[2] ..... F16C 1/26; F16C 29/00

[58] Field of Search ..... 308/4 R, 4 A; 175/325; 24/136 B, 263 DC, 263 DD, 263 SC, 263 KS

[56] References Cited

UNITED STATES PATENTS

| | | | |
|---|---|---|---|
| 1,258,580 | 3/1918 | Lassiter | 24/263 KS UX |
| 1,810,948 | 6/1931 | Dorn et al. | 308/4 A |
| 2,346,706 | 4/1944 | Stoner | 24/136 B X |
| 2,493,556 | 1/1950 | Stone | 24/263 DD X |
| 3,042,125 | 7/1962 | Duncan | 308/4 A UX |
| 3,276,824 | 10/1966 | Carter | 308/4 A |
| 3,482,889 | 12/1969 | Cochran | 308/4 A |
| 3,614,140 | 10/1971 | Nestor | 24/136 B X |

*Primary Examiner*—Donald A. Griffin
*Attorney, Agent, or Firm*—Jennings B. Thompson

[57] ABSTRACT

A stabilizer is disclosed that can be mounted on the outside of the drill string. It includes a tubular body having a bore to receive the drill string to allow the body to be moved over the drill string to the desired location. A portion of the bore has a locking taper in which is located a plurality of slip fingers. A sleeve member is connected to the body by threads and is in engagement with the slip fingers. Relative rotation of the sleeve and the body will cause the sleeve to force the slip fingers along the tapered bore of the body and into frictional engagement with the outside surface of the drill string to hold the stabilizer in the desired location thereon.

2 Claims, 3 Drawing Figures

STABILIZER

This invention relates to stabilizers of the type used in drilling operations.

Stabilizers are used to provide lateral support to the drill string at one or more selected points above the drill bit. They are used for various reasons. They can serve as a fulcrum to reduce or increase the angle from vertical of a drilled hole. They are also used to center the drill string in the well bore to urge the drill bit to continue drilling in a straight line.

For whatever purpose they are used, the distance that stabilizers are spaced above the drill bit or from each other will vary from time to time, depending upon the situation. Conventional stabilizers are provided with tool joints and are connected into the drill string between sections thereof. This means the stabilizer is not located above the bit or from another stabilizer at the desired location, but at the closest threaded connection in the drill string to the desired location. Also, stabilizers are located usually somewhere in the drill collar section of the drill string. When the pipe is pulled from the hole, the drill collars are preferably handled in three joint stands. If it is necessary to insert a stabilizer in the middle of a stand, the stand must be broken down and the stabilizer inserted. This is a time consuming operation. It also requires the stabilizer to be provided with tool joints of the same quality as those used in the drill string, which greatly increases the cost of the stabilizer.

Therefore, it is the object of this invention to provide a stabilizer that can be conveniently and quickly attached on the outside surface of a section of a drill string at any desired location and which can be removed or relocated without having to break out or make up any additional threaded connections in the pipe string.

These and other objects, advantages and features of this invention will be apparent to those skilled in the art from a consideration of this specification including the attached drawings and appended claims.

A drill string usually includes a lower drilling assembly and the drill pipe that extends from the drilling assembly to the surface. The drilling assembly includes drill collars and the bit. Stabilizers are usually positioned in the drilling assembly, although they are placed in the drill pipe section on some occasions.

Figure 1:
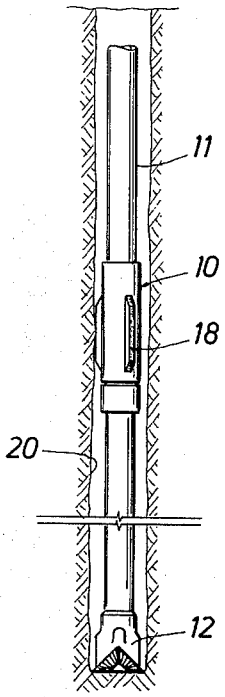
FIG. 1 is a view in elevation of the lower portion of a drill string in a well bore with a preferred embodiment of the stabilizer of this invention positioned above the drill bit.

Stabilizer 10 is shown in FIG. 1 mounted on the outside surface of drill collar 11. Drill bit 12 is attached to the lower end of the drill string, which may be drill collar 11 or there may be several drill collars between the bit and drill collar 11. Only one stabilizer is shown, although several may be spaced apart along the drilling assembly.

Figure 2:
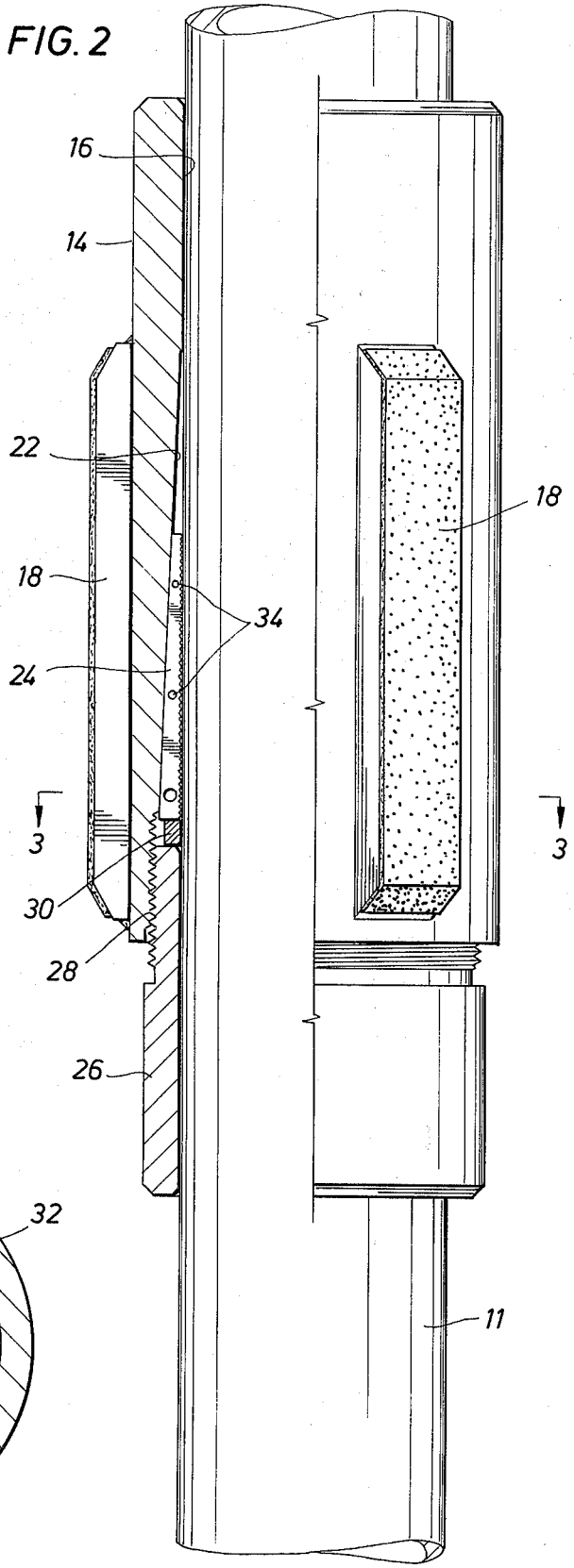
FIG. 2 is a view, on an enlarged scale, of the stabilizer of FIG. 1, partly in elevation and partly in section.
Figure 3:
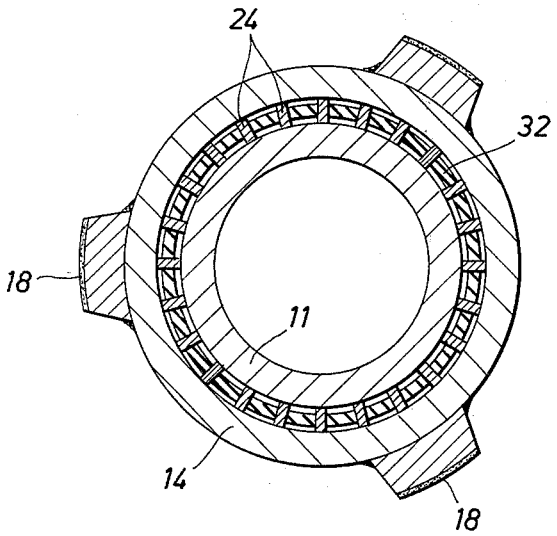
FIG. 3 is a cross-sectional view taken along line 3—3 of FIG. 2.

As shown in FIG. 2, stabilizer 10 includes body 14, having central bore 16 large enough to allow the body to be slipped over the drill collar and moved to the desired position on the collar. Located on the outside of body 14 are longitudinally extending ribs 18, which engage the wall of well bore 20 to hold the drill string away from the well bore in the conventional manner.

Bore 16 has tapered portion 22 in which slip means are located to anchor body 14 on the outside of drill collar 11. In the embodiment shown, the slip means include a plurality of spaced parallel slip fingers 24. These fingers are positioned to be parallel to the longitudinal axis of the stabilizer body and the drill collar upon which the stabilizer is mounted. The back or outside surface of each finger is tapered to match the taper of tapered bore 22. The inside surface is knurled or provided with teeth to help increase the friction between the fingers and the outside surface of drill collar 11.

Means are provided to force the slip means into frictional engagement with the outside surface of the drill collar to hold the body of the stabilizer against longitudinal movement. In the embodiment shown, sleeve 26 is connected to body 16 by threaded connection 28. Located between sleeve 26 and slip fingers 24 is friction ring 30. Relative rotation of sleeve 26 in body 14 will cause the sleeve to move into the bore of the body and exert a foce on friction ring 30 which in turn forces slip fingers 24 along tapered bore 22. As the slip fingers move along the tapered bore, they are forced inwardly into firm engagement with the outside surface of drill collar 11.

The stabilizer is held against longitudinal movement in either direction by slip fingers 24 by providing tapered bore 22 with a "locking" taper. In other words, above a given angle for the materials involved, slip members, such as fingers 24, will hold against longitudinal movement in one direction only. Below such an angle, however, the slips can be wedged between the tapered bore and the drill string and they will tend to be "locked" in place and will hold against movement in either direction. Bore 22 has such a taper. In one embodiment, an angle of between 2½° and 3° from the longitudinal axis was found to provide the slip fingers with sufficient holding power to resist movement when subjected to greater than expected longitudinal and rotational forces. The taper, of course, can be varied to provide the holding power desired as long as it is within the range of locking tapers for the material involved.

The slip means includes means to hold the slip fingers in spaced, parallel, relationship while allowing the fingers to move inwardly and outwardly as required when installing and removing the stabilizer from the drill collar. In the embodiment shown, slip fingers 24 are embedded in annular body 32 of elastomeric material. In this embodiment, the annular body does not extend longitudinally beyond the ends of the slip fingers but is integrally connected across the slip fingers through a plurality of openings 34 extending through the slip fingers, as shown in FIG. 2.

In operation, the stabilizer body is slipped over the pipe section, usually a drill collar, upon which it is to be mounted and moved to the desired location. The slip fingers assembly is then positioned in tapered bore 24 by moving it upwardly into the bore having been previously slipped over the drill collar along with friction ring 30 and sleeve 26. Sleeve 26 is then rotated relative to body 14 until sufficient friction is generated between the slip fingers and the drill collar to hold the stabilizer in place during drilling operations.

To remove the stabilizer from the drill collar the procedure is reversed. It will be necessary to exert a relatively large force upwardly on the body due to the locking taper used for the bore of the body. The same stabilizer can be used for a range of drill collar diameters by using friction rings of different widths to adjust for the different distances the slip fingers move into the tapered bore.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A stabilizer for mounting on a drill string for limiting the lateral movement of the drill string during drilling operations comprising a tubular body for positioning on the drill string in the desired location and having a bore with a locking taper that increases in diameter toward one end thereof at an angle of about 3°, a plurality of spaced parallel slip fingers for positioning between the tapered bore and the drill string and parallel to the longitudinal axis of the bore, each finger having a tapered outer surface to engage the tapered bore of the body, means for holding the fingers in said parallel relationship, and means for forcing the fingers longitudinally of the body to cause the tapered outer surface of the fingers to move along the tapered bore and be forced inwardly into frictional engagement with the drill string sufficiently to hold the body from movement longitudinally in either direction from the desired position on the drill string while the drill string is used in a drilling operation.

2. The stabilizer of claim 1 in which the means for holding the slip fingers in parallel relationship comprises an annular body of elastomeric material.

* * * * *